United States Patent [19]

Merkl

[11] 4,180,444

[45] Dec. 25, 1979

[54] ELECTROLYTIC METHODS EMPLOYING GRAPHITIC CARBON CATHODES AND INORGANIC COMPLEXES PRODUCED THEREBY

[75] Inventor: George G. Merkl, Haworth, N.J.

[73] Assignee: Merkl Technology, Inc., Houston, Tex.

[21] Appl. No.: 896,372

[22] Filed: Apr. 17, 1978

Related U.S. Application Data

[63] Continuation-in-part of Ser. No. 795,979, May 11, 1977, abandoned.

[51] Int. Cl.[2] ..... C25B 1/00

[52] U.S. Cl. ..... 204/90; 204/86; 204/91; 204/92

[58] Field of Search ..... 204/90, 91, 92, 59 R, 204/86

[56] References Cited

U.S. PATENT DOCUMENTS

| | | | |
|---|---|---|---|
| 1,485,706 | 3/1924 | Plauson | 204/91 |
| 2,273,799 | 2/1942 | Janes et al. | 204/91 |
| 3,103,473 | 9/1963 | Juda | 204/91 |

*Primary Examiner*—R. L. Andrews

*Attorney, Agent, or Firm*—Arnold, White & Durkee

[57] ABSTRACT

Low voltage, low amperage electrolytic processes employing graphitic carbon as the cathode are disclosed. Unique inorganic water soluble complexes are produced when electrolytes are employed containing nonmetallic compounds which may be reduced or hydrogenated to provide hydrogen-containing, electrically charged radicals, specifically hydrides, such as $NH_x$, $SH_x$ and $PH_x$. The complexes appear to be polymeric in nature, and contain graphitic carbon and/or any nonalkaline metal selected from Groups I-VIII of the Periodic Table as a backbone, depending upon the nature of the anode and the electrolytic process employed.

24 Claims, 7 Drawing Figures

ELECTROLYTIC METHODS EMPLOYING GRAPHITIC CARBON CATHODES AND INORGANIC COMPLEXES PRODUCED THEREBY

RELATED PATENT APPLICATION

This application is a continuation-in-part of application Serial No. 795,979, filed May 11, 1977, now abandoned.

SUMMARY OF THE INVENTION

The present invention is directed to unique electrolytic methods employing graphite or a suitable equivalent as at least one electrode, the cathode, and preferably as both electrodes. Inorganic, water soluble, complexes, which appear polymeric, are produced, the nature and utility of which will depend on the nature of the particular electrolyte utilized and whether one or more metals are also introduced into the reaction.

The term "graphitic carbon", as used throughout this disclosure, is intended to refer to graphite and materials which are the functional equivalent of graphite in its characteristics of conducting electrons and absorbing and retaining within its structure both ionized and molecular gases, compounds and complexes with which it comes into intimate contact, most typically through contact with solutions.

More specifically, the present invention provides for electrolytic methods whereby inorganic, water soluble complexes are produced, which methods comprise passing a current between two electrodes, at least one of which is a graphitic carbon cathode, as defined above, through an electrolyte which is an aqueous solution of any compound or complex of compounds capable of being absorbed and retained by the graphitic carbon of the cathode and reduced or hydrogenated at the cathode to a hydride species. The hydride species which are electrically charged are transported directly to the anode surface, and the anode is of a material which reacts with such electrically charged species to produce the desired water soluble complex.

It has been found that when graphite or its functional equivalent as explained above is placed into intimate contact with certain chemical materials, the contact most typically being in an electrolytic environment, these chemical materials are absorbed into the structure of the graphite. Most typically, it has been found that gases will be absorbed by the graphite, both those which are generated by the electrolytic action at the graphite electrode, but also gases which have been absorbed into the electrolytic medium. The present invention utilizes this phenomenon to provide compounds and complexes which, when in the reduced or hydrogenated state resulting from cathodic action, react with a sacrificial anode to produce inorganic complexes which appear polymeric in nature and are water soluble.

It is a feature of the invention that the sacrificial anode employed in the electrolytic methods utilizing a graphitic carbon cathode may, itself, be a graphitic carbon electrode. In this embodiment, the invention provides a technique for dissolving graphitic carbon and producing unique, inorganic, water soluble complexes containing graphitic carbon. These complexes are valuable products due to their gas absorbing properties, i.e., absorb gases such as $SO_2$ and $H_2S$ in pollution control processes and can be used effectively as catalysts, such as in the conversion of wood or starch to dextrose and in the hydrogenation of coal, peat, etc.

It is also a feature of the present invention, as will be more fully explained herein, that the sacrificial anode employed in the electrolytic methods of the present invention may be any non-alkaline metal selected from Groups I–VIII of the Periodic Table. Thus, the present invention provides methods of providing solutions of water soluble, inorganic complexes containing metals, some of which have heretofore never been available in aqueous solutions. These metal-containing solutions have significant utility in techniques such as plating from aqueous solution, both with and without electrolysis. These metal containing complexes also have utility as gas absorbants in pollution control processes.

More specifically, the particular reactants employed in the method of the present invention will depend primarily upon the properties of the inorganic complexes desired as end products. For example, inorganic complexes prepared using an anode of silicon, aluminum, graphite or mixtures thereof with an aqueous solution of ammonia as the electrolytic solution will have valuable utility in fertilizer compositions. Complexes prepared using aluminum as the anode in an electrolytic solution containing sulfur dioxide have been demonstrated to have a valuable utility in the absorption of $SO_2$ or $H_2S$ gases from stack gas mixtures. Complexes prepared with refractory metals, such as tungsten, titanium, molybdenum, and the like, are, because of their water soluble characteristics, useful in plating from aqueous solution.

As indicated above, the complexes appear polymeric in nature. They can be dried to polymer-like films which can be redissolved in water. The dried films of complex exhibit the unique characteristic of sublimation.

The essential materials necessary in the method of the present invention are the following:

A gas-absorbing, graphitic cathode;

A sacrificial anode, which may be an identical material to the cathode but also may comprise any non-alkaline metal selected from Groups I–VIII of the Periodic Table, with the proviso that the metal is capable of electrolytic dissolution in the present method, a mixture of such metals, or a mixture of one or more such metals with graphite; and an electrolyte containing essentially any compound capable of being absorbed into the structure of the graphitic cathode and reduced or hydrogenated at the cathode to produce electrically charged hydride species such as $NH_x$, $SH_x$, $PH_x$ and the like, wherein x is an integer representing the number of hydrogen atoms in the electrically charged hydride species. This electrolyte compound is preferably selected from the group consisting of ammonia and hydrides and oxides of nitrogen, sulfur and phosphorus.

The present invention is based upon the discovery of a combination of simultaneous physical occurrences, all of which relate to the unique characteristics of graphite and its use as a cathode. In a traditional electrolytic process wherein ammonia or a dissolved hydrogen-producing gas is in the electrolyte, the electrolysis typically produces a bubbling off of hydrogen gas at the cathode. It has been discovered, however, according to the present invention, that if graphite or an equivalent is utilized as the cathode, some of the hydrogen evolved in the electrolytic process will be absorbed and retained at the cathode. This hydrogen, possibly in ionic form, will then be available to react with any electrolyte compounds which are also absorbed by the graphite, and which may be in a reduced state as a result of the cathodic action. This results in the production of additional hydrogen (perhaps in atomic form) as well as the creation of negatively charged radicals containing hydrogen, i.e., hydride species.

Also, in the electrolytic method the hydrogen and the hydride species which are generated at the cathode will begin to migrate to the anode as if traveling along the lines of the electric field. These groups will then react with the positive ions at the anode to begin to produce inorganic complexes soluble in the electrolytic solution.

DETAILED DESCRIPTION OF THE INVENTION

The Cathode

Figure 1A:
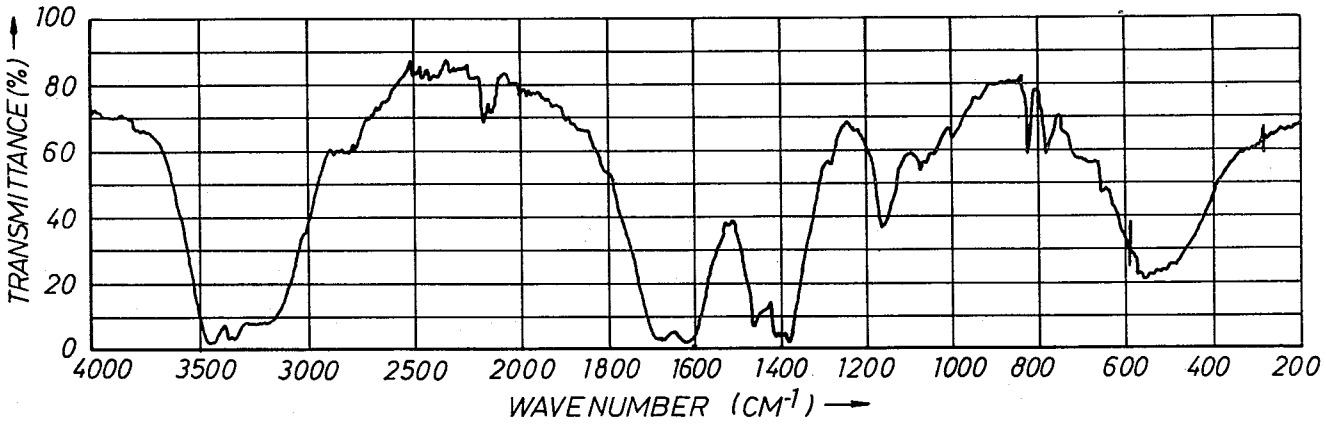
FIGS. 1A–E illustrates a series of infrared spectra of a inorganic complex produced according to the present invention after such complex had been vacuum-dried and heated at progressively higher temperatures.
Figure 1B:
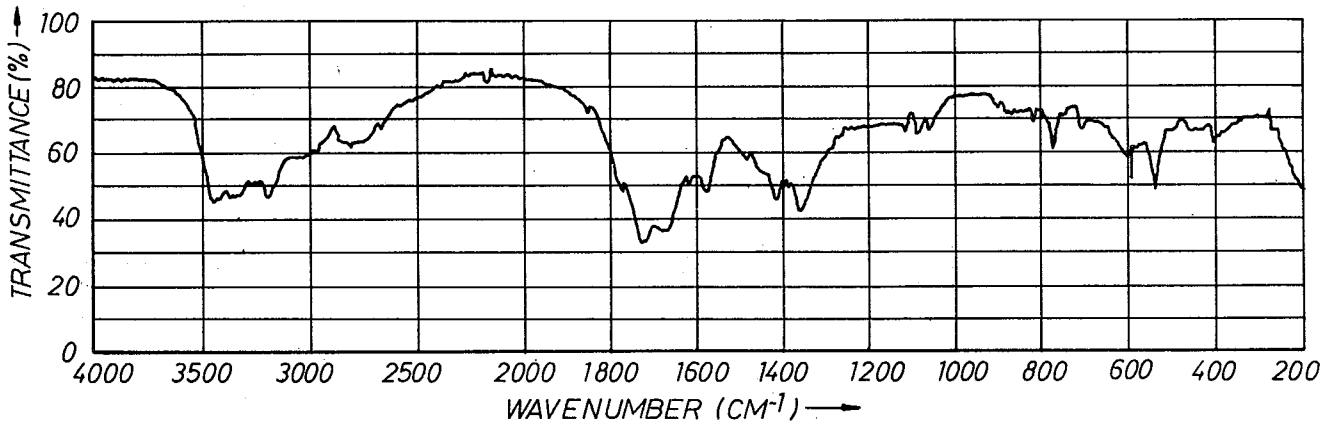
Figure 1C:
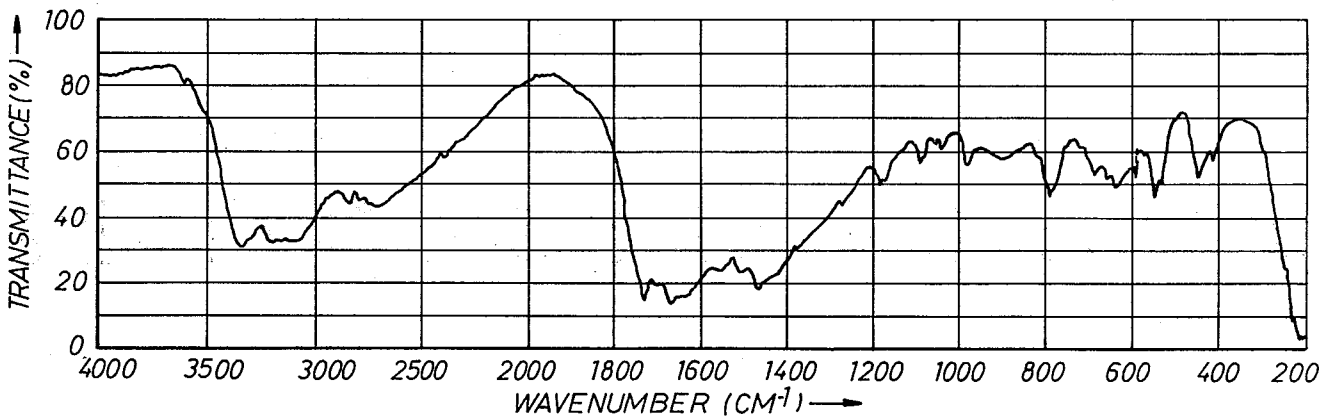
Figure 1D:
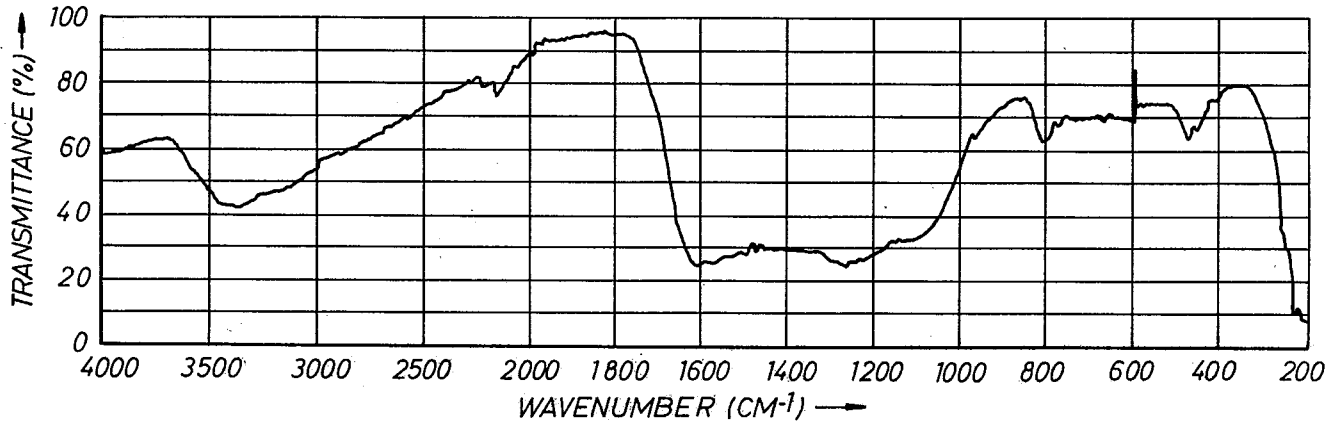
Figure 1E:
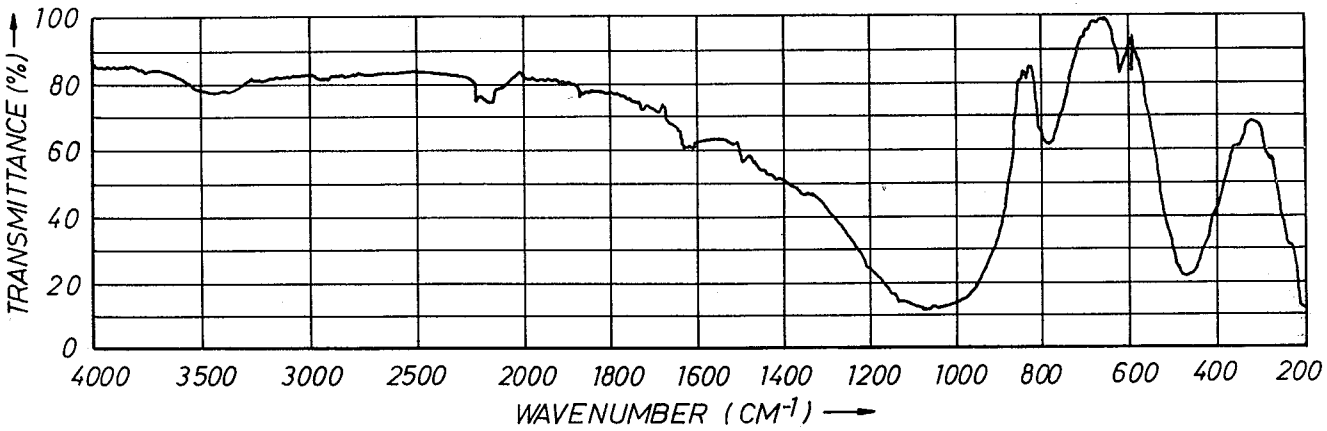

It is an essential requirement of the invention that the cathode in all instances be comprised of graphitic carbon, or its functional equivalent.

Graphite, of course, is a naturally conductive material. That is, it is capable of carrying electrons and is a very effective electrode in electrolytic procedures. Unlike most conductive materials, however, graphite also has the capability of absorbing and retaining within its structure gases such as hydrogen, ammonia, sulfur dioxide, hydrogen sulfide and the like. This gas-absorbing capability arises out of the unique physical structure of graphite.

It was long ago established by X-ray analysis that the carbon atoms in graphite are arranged in layers, each containing a continuous network of planar hexagonal rings. Within each layer, the carbon atoms are held together by strong, covalent bonds. The layers themselves, however, are held together by comparatively weak forces.

The separation between the graphite layers has been measured to be 3.35 Angstroms. It has further been determined that within each layer, each carbon atom is surrounded by only three others, in a uniform hexagonal configuration, similar to that of benzene, wherein the distances between the carbon atoms are all equal at 1.415 Angstroms. Thus, it is apparent that many atoms, molecules and ions may be inserted between the carbon layers and even, to some extent, within the graphite structure itself. This ability to absorb gases and to maintain them inside the graphite structure permits reduction reactions to be carried on inside the electrode itself.

One way in which it has been demonstrated that the graphite electrode actually absorbs certain gases and causes an internal reduction reaction to occur when used as a cathode is to take the cathode after it has been used in the reaction of the present invention and submit it to degassing techniques.

The many forms of so-called amorphous carbon, such as charcoal, soot and lampblack, are all actually microcrystalline forms of graphite. The microcrystals may be so small as to contain only a few unit cells of the graphite structure. Nevertheless, the graphite structure exists and thus these forms of carbon, with their ready ability to absorb large amounts of gases and solutes from solution, may be utilized as generally less preferred substitutes for the graphite cathode. Graphite is generally preferred because of its ability to be molded into a convenient shape for use as an electrode and for its good conductivity.

As will be more fully explained subsequently, the reaction method of the present invention has been carried out employing a graphite anode, as well as a graphite cathode. In such processes, graphite from the anode is dissolved into the solution. It has been observed that the dissolved graphite which begins to appear in solution will, itself, act as a cathodic electrode. Power may be shut off and yet there will still be a current flow due to the ability of the dissolved graphite particles to absorb and collect negative charges.

In the unique processes of the present invention, the reduction which occurs inside the graphitic cathode produces electrically charged species which are extremely reactive and will readily give up electrons when they contact the surface of the anode. This results in the formation at the anode of soluble inorganic complexes containing as a backbone thereof the material of the anode. Because they are formed from species which have been created at the cathode by reduction and reaction with hydrogen, these compounds will typically have a hydride-like linkage contained in the body thereof.

The reduction process which occurs inside the cathode will also occur at or near the surface of the cathode. In many instances, reduction of dissolved metal compounds will result in a plating out of the metal compound on the cathode surface. This does not necessarily stop the production of the species which result in the formation of the unique products of the present invention. It has been observed that the coatings which form on the surface of the cathode are porous and, to some extent, permit passage of the gases and other species generated inside the cathode itself. However, it has been observed that with certain particular combinations of reactants the cathode will have to be replaced from time to time in order to continue the formation of the inorganic complexes of the present invention. The need for replacement of the cathode can be easily observed when carrying out the elctrolytic method.

Most typically, the electrolytic reaction of the present invention, more specifically, the absorption by the cathode of hydrogen, hydrogen ions and gases or other compounds dissolved in the electrolyte and the subsequent reduction and/or hydrogenation of these materials, results in the production of hydride species which, when transported by the electric field to the surface of the anode, produce the inorganic complexes. As will be apparent to those skilled in this art, the larger the graphite cathode which is utilized, the more surface area and internal structure will be available for absorption and retention of the electrolyte compounds and their subsequent reduction to produce charged radicals desirable to carry out the reaction of the invention. Accordingly, where such processes as dissolution of metals are desired, reduction will be emphasized and the size of the cathode should be adjusted accordingly. On the other hand, where oxidation type reactions are to be emphasized, as for example utilizing a graphite cathode and a graphite anode, it is the graphite anode which should be increased in size in relation to the cathode. This can be done most simply by placing chunks of graphite material in the bottom of the reaction flask. These chunks of graphite material will then act in union with the standard anode electrode to form a larger anodic surface.

The Anode

There are basically three variations in the broad concept of the present invention, each depending on the utilization of a different anodic system. In the first variation, a graphitic carbon anode is utilized with the graphitic carbon cathode. In this embodiment of the invention, where the electrolyte contains a compound such as a member of the group consisting of hydrides and oxides of nitrogen, sulfur and phosphorus (all of which are readily transformed, by reduction and/or hydrogenation, at the graphite cathode), the invention provides a technique for dissolving graphitic carbon and producing unique, inorganic, water soluble materials containing graphitic carbon.

It is particularly important when employing a graphite anode with a graphite cathode that the current used, in relation to the size of the reactor and electrodes, be such as to minimize any oxidation process, which may produce undesirable gases, such as acetylene. Essentially all that is necessary for carrying out the present invention is that a potential difference be developed between the electrodes and that the electrodes, of course, be positioned such that the electric field passes a current between the electrodes, thereby causing at least a portion of the gases evolved at the cathode during electrolysis to be transported physically to the anode.

Since the preferred hydride producing compounds are all weak electrolytes, there will be little hydrogen generated initially to be absorbed by the cathode, and the process may take several days before any significant dissolution of the graphite anode is visible. Here again, patience is important. The use of a stronger electrolyte, particularly an alkali metal compound, may result in an undesirable reaction and could cause an explosion.

It is a significant discovery resulting from the present invention that as the hydrides are developed according to the reaction and cause dissolution of graphite at the anode, the water soluble, inorganic graphite containing complexes produced thereby significantly increase the electrolytic conductivity of the solution, thereby increasing the rate of reaction. It is postulated that this increase in conductivity results from the graphite structure of these soluble products absorbing and retaining negative electrical charges.

In the second anodic variation, a base metal is utilized as the sacrificial anode. In this embodiment, it will be apparent that only those metals which are capable of dissolving during electrolysis may be utilized. It is also important that the two electrodes be properly positioned and that a small current be passed between them.

When utilizing base metal anodes, especially with highly conductive electrolytic solutions, the tendency will be for oxidation reactions to predominate. Thus, in the first place, the reduction process necessary to form the species which are essential in producing the inorganic complexes of the present invention will be masked. Secondly, oxidation may result in the plating out on the cathode of the base metal. This will have a tendency, in many instances, to slow down the electrolytic reaction. Thirdly, where the electrolyte contains an alkali, there may be some production of intermediate salts and/or oxides, which will crystallize out and collect on the surface of the electrolytic vessel and/or the cathode. These adverse reactions may be minimized by maintaining the current at a low level in the initial stages, but it may also be desirable to utilize a large graphitic cathode, as discussed above.

There is one exception to the limitations referred to above. This is, when a previously prepared inorganic complex containing graphite is utilized in the electrolyte. When such an electrolytic solution is utilized, those metals which do not normally dissolve electrolytically can also be used. In effect, any non-alkaline metal of Groups I–VIII of the Periodic Table may be utilized as the anode when the electrolyte contains graphitic carbon complex produced according to the present invention. The term non-alkaline metal is meant to embrace all metals excluding only the alkali and alkaline earth metals, such as barium, calcium and strontium.

Where the electrolyte contains no dissolved graphite material, unique inorganic complexes, soluble in water, may still be produced by employing as anodes certain base metals, such as aluminum, which dissolve normally upon electrolysis. Many complex inorganic, water soluble products may be produced according to the invention wherein the base metal is associated with radicals which would not otherwise be capable of reacting with the metal.

The third anodic variation contemplates the use of both graphite and a non-alkaline metal selected from Groups I–VIII of the Periodic Table as the anodic electrode.

In this variation there are three possibilities, an electrode which is a physical combination of graphite with the particular metal, a graphite electrode with a quantity of the metal being placed in the bottom of the electrolysis vessel, and a metal electrode with a quantity of graphite placed in the electrolysis vessel. It is preferred according to the present invention to employ a system utilizing a graphite electrode as the anode, placing a quantity of the non-alkaline metal to be dissolved in the electrolysis vessel prior to setting up the electrolysis. This is because, as explained above, the graphite anode may be more readily positioned with respect to the cathode to produce an efficient and effective dissolution of graphite. Once the graphite is in solution, the electrolytic nature of the dissolved graphite complexes takes effect, as explained above, accelerating the efficiency of the process. Also, it is easier to control the direction of the electrolytic process by utilizing graphitic anodes and cathodes of varying relative sizes. One particularly preferred configuration is to utilize a large, hollow cylindrical graphitic cathode and a small cylindrical bar of graphite as the anode. The small electrode may be placed inside the hollow of the cylinder, the amount of insertion thereof providing a very effective control for the production of the most desirable current and electric field.

As noted above, when graphite is used as any part of the anode, the electrolytic process of the present invention is capable of dissolving any non-alkaline metal from Groups I–VIII of the Periodic Table. Whether the non-alkaline metal be comprised of the electrode itself or be placed in the electrolysis vessel as chunks, particles or even powder, the actual electrode must be positioned in relation to the quantity of material in the electrolysis vessel so that the total mass of the combination of non-alkaline metal and graphite acts anodically. It has been found not to be necessary in all instances to provide direct, physical contact between the graphite and the non-alkaline metal. As a matter of fact, in the preferred embodiment wherein graphite is employed as the anodic electrode, there is less of a tendency to produce oxidation products where there is no direct physical contact. It is believed that the production of dissolved graphite-based inorganic complexes actually facilitates the transfer of the charged radicals which attack and dissolve the non-alkaline metal.

The Electrolyte

Generally speaking, in an electrolytic process an electrolyte is anything which is capable of carrying a current between two electrodes. In the present invention, the definition is almost as broad, the type of suitable electrolyte being limited only by such parameters as its ability to dissolve the complexes formed in the reaction process and, more importantly, the compounds which are to be absorbed, retained and reduced or hydrogenated by the graphitic cathode to hydride species which are thereafter transported through the electrolyte to the anode.

Accordingly, the present invention contemplates the use of any electrolyte containing in dissolved or ionized form a quantity of any atom, molecule, ion or complex which is capable of being absorbed and retained by graphite from an electrolytic medium and electrically transformed, by reduction or hydrogenation, to an electrically charged species capable of reaction with the sacrificial anode material, specifically hydride species, to produce an inorganic complex material which is soluble in water. The only apparent limitations are the size of the material in its unitary structure (atom, ion, molecule or complex) and its ionic nature, that is, whether it is capable of being reduced and/or hydrogenated to a state where it will react with the anode. Compounds of nitrogen, sulfur or phosphorus, specifically hydrogen-containing gases, such as $NH_3$, $H_2S$ and $PH_3$, as well as oxides such as $NO_x$ (NO and/or $NO_2$), $SO_2$, $P_2O_5$, and the like, which are capable of being reduced to hydrides, are particularly valuable in the production of the inorganic, water soluble, complexes as will be further described. However, solutions of weak acid and dilute solutions of strong acids such as $H_3PO_4$ can also be utilized as electrolytes in the present method.

It is characteristic of the reaction of the present invention that the reaction proceeds very slowly, sometimes taking days before some visible change has occurred. The nature of the electrolyte will to some extent have an effect on the rate of the reaction. However, typical means of speeding up an electrolytic reaction, such as heating or increasing the current, are generally not appropriate since these means will simply increase the traditional electrolytic type reactions or, in the case of ammonia, for example, result in an increased bubbling off of ammonia gas. However, in some cases, gentle heating has been beneficial.

While most of the preferred electrolyte compounds do not have a very high solubility in water (in the sense that they do not readily disassociate), the concentration of the electrolyte will ordinarily not be a critical factor. The acceptable concentration range for most electrolyte compounds is limited on the low side only to the extent that enought molecules be in the water to provide a continuous visible reaction and limited on the high side only by the concentration solubility characteristics of the compound.

It is preferred to initiate the reaction by having some electrolyte in the solution prior to passing a current between the electrodes. Since some of the preferred electrolyte compounds have a relatively low solubility ratio, and since the compound is used up in the reaction, it will be required in some procedures that there be an addition of compound to the rection medium during the course of the electrolytic process. This can be by any suitable means.

As has been alluded to, certain compounds have such a low conductivity that it may be desirable to add to the solution, prior to or during the electrolysis, a small amount of a strong electrolyte having other than a neutral pH, such as an alkali hydroxide or the like, to increase the reaction rate.

Finally, the electrolyte may also contain an amount of inorganic graphite-containing complex previously prepared according to the present invention. As has been mentioned, the dissolved graphite particles apparently have the capability of absorbing electrons and therefore producing a very high conductivity. In addition, it appears that cathodic reduction takes place at or inside these dissolved graphite particles, thus further increasing the efficiency of the electrolytic process.

It should be noted that under some circumstances, at least when ammonia is utilized in the electrolyte, there is an intermediate product precipitated out on the sides of the electrolysis vessel during the course of the method of the present invention. This material is crystalline, has a six-sided crystal structure and is soluble in water. It appears to be an amide or hydride salt, formed by the reaction of $NH_2$ groups with the graphite. It does not form a film when dried as does the final complex. When a non-alkaline metal is employed in the process, an intermediate precipitate also appears, but which is heavier, obviously due to the presence of the metal.

The appearance of this intermediate "salt" can be used as an indication of how the method is developing. If too much salt begins to form, this is an indication either that there is too much metal going into solution or that there is not enough ammonia in the system and metal hydrides are being formed. Heating the reaction will help the salt to break down and also not to develop too fast. Increasing the amperage of the electrolytic current will also to some extent offset the excess production of this intermediate and push the reaction back to the production of desired complex.

Basically, the parameters for electrolysis are simple: keep the reaction relative cool and the current as low as possible. Most reactions proceed quite well at temperatures below about 60° C. This basic rule will have to be modified occasionally to offset the production of excess intermediate. This can also be accomplished by maintaining the reaction vessel under a slightly elevated pressure. This helps to "push" the hydrogen gas evolved at the cathode into the system and also helps keep the dissolved gases from escaping at the anode. When ammonia is used, for example, too much heat and/or too much current will result in the escape of ammonia, both in the form of ammonia gas and also by a breakdown of the intermediate amide salt.

It is most important that the current density, that is, the average current per unit volume of reaction, be kept low. It is preferred that this be accomplished by maintaining a very high surface area for the cathode. As has been mentioned, too much current will cause the driving off of gases such as ammonia and may also cause adverse oxidation reactions to occur. Hence, as a general rule the wattage should be kept relatively low, the reaction drive force being maintained by having a very high surface area for the chosen electrode.

On a laboratory scale, it has been determined that best results are achieved with a current of about 0.1 to 4 amps and a low voltage, up to about 25 volts. It is apparent that higher voltages and/or currents might be utilized on a commercial scale and the determination of applicable parameters can be easily carried out by one skilled in the art. This is done by observing the course of the reaction, specifically the dissolution of the sacrificial anode, transfer of bubbles from cathode to anode and formation of the desired and side products. Preferably the reaction should be carried out to achieve a transparent solution, although slightly colored solutions indicative of larger crystals of graphitic carbon are acceptable.

The invention will now be described with particular reference to certain preferred embodiments, set forth in the following specific examples. Such examples are presented for the purposes of illustration only and to comply with the requirements of 35 U.S.C. § 112, paragraph 1. They should not under any circumstances be deemed as limiting the present invention. In the examples, unless otherwise indicated, all percentages are by weight. A power source having a maximum output of 25 volts was utilized in the electrolytic processes. Where reference is made to a commercial ammonium hydroxide solution, it is intended to refer to a 26 Be° solution (which is 38% by weight $NH_3$).

EXAMPLE 1

This example was carried out to illustrate the preparation of an inorganic graphite-containing complex according to the present invention, the complex containing NH and/or $NH_2$ groups. An electrolysis system was set up utilizing aqueous ammonia as the electrolyte and utilizing a graphite anode and cathode. The electrolysis vessel was a 6 liter boiling flask, the electrodes comprising graphite rods 12" in length and the electrolyte comprising 2,100 grams of 2,333 ml of aqueous ammonia (26° Be). Into the electrolysis vessel were added 986 grams of additional graphite.

Initially, the graphite anode is place in contact with the graphite in the bottom of the flask. The graphite cathode is placed at a distance from the graphite anode and the graphite in the electrolysis vessel which will yield a maximum current but also be such that the gas evolving from the cathode (hydrogen) does not bubble off but rather travels along the surface of the solution to come into contact with the anode.

The electrolysis was initiated by applying a current from a 25 volt power source across the electrodes. The conditions mentioned above were established at a maximum current of 0.1 amps at 20 volts. Initially the current is small due to the low conductivity of the electrolyte.

The system is then left essentially undisturbed for approximately 44 hours, after which the current was able to be adjusted to 0.15 amps at 24.5 volts. Approximately 24 hours later the current is still 0.15 amps at 24.5 volts and the reaction is observed as proceeding slowly. After a further 24 hour period the electrodes are moved closer together and the cathode also moved closer to the graphite in the electrolysis vessel. At this stage a current of 0.35 amps was measured at a voltage of 25 volts. The system is allowed to remain substantially undisturbed in this state for a further period of approximately 72 hours.

At this time, the system was observed to be drawing 1.4 amps at 25 volts. The increase in the current is apparently due to the increased conductivity of the electrolyte solution as the graphite goes into solution. At this time some gas is noted as evolving from the anode (possibly acetylene) and the solution appears to be getting darker.

Some 24 hours later the system is observed to be drawing 2.1 amps at 24.5 volts. The reaction vessel is hot to the touch and gas is still noted as evolving. After an additional 24 hour period the system is observed to be drawing 2.7 amps at 25 volts, and after a still further 24 hour period the system pulls 3.4 amps at 25 volts. The reaction system is hot and the solution now appears very dark in color, apparently due to the dissolution of the graphite in the rcaction system, as the anode is now visibly eroded.

At this point some 2,200 ml of aqueous ammonia are slowly added to the electrolyte. The system cools down, but no ammonia odor is detected. After this addition of the aqueous ammonia, the current was set at 2 amps and 20 volts. The sytem was allowed to remain in this state substantially undisturbed for 4 days.

After this time the reaction vessel is observed and noted to be hot, a gas is still seen to be evolving from the anode and the system draws 1.7 amps at 21.5 volts. After an additional 24 hour period it is noted that the graphite anode has almost totally eroded away and out of the electrolyte. The reaction vessel has cooled. The anode is repositioned in the solution and the current is set at this time at 2 amps at 23 volts. After an additional 24 hour period the reaction vessel is again warm, and the current has increased to 2 amps and 17.5 volts. The next day, the anode has again eroded away. After readjusting the anode, the current is again set at 2 amps and 24.5 volts. After approximately 5 hours under these conditions the current is adjusted to 3.7 amps and 24.5 volts under which conditions a gas, presumably acetylene is seen to be evolving. The reaction is then terminated by withdrawal of the graphite anode and cathode.

During the course of the reaction it is noted that the electrolyte has grown darker in color and that a layer which appears as a cloud of bubbles developes in the upper portion of the reaction vessel. This appears to be an indication that the rate of dissolution of the graphite is too fast and some graphitecontaining by-products are being formed.

After the termination of the reaction, the electrolyte is removed from the electrolysis vessel. The product is prepared in the form of an aqueous solution of an inorganic complex analyzed to contain graphite and NH and/or $NH_2$ linkages.

Quantitative analysis of the complex prepared according to the procedures outlined above was carried out using ASTM standard test method #56, which is the so-called Kjeldahl distillation technique, to determine the amount of nitrogen present in the product. This is basically a reduction of bound nitrogen to ammonia, with the subsequent steam distillation of the ammonia into an excess acid solution. The excess acid is then back titrated with sodium hydroxide to determine the amount which reacted with the liberated ammonia.

Prior to this test the complexes were air-dried, and then vacuum-dried at 50° C. until there was no trace of ammonia vapor detected. The dry polymer was then heated with concentrated sulfuric acid and potassium dichromate through the fuming state, almost to dryness.

The amount of carbon present was quantitatively determined by combustion of the products, followed by an absorption of the $CO_2$ gases which result. These two tests showed that the product contained 73% nitrogen and 12% carbon, dry weight.

The graphite electrodes employed were taken from the electrolysis solution, rinsed thoroughly with deionized water, and then placed in a standard acid solution overnight. The next morning, the solution and electrodes were boiled. The resulting solution was then back titrated to determine the amount of acid which had been consumed by reaction with the ammonia which had been absorbed into the electrode. The fact that the electrode had absorbed ammonia gas was determined by a gas chromatograph analysis. After rinsing the electrode with deionized water, the electrode was placed in a combustion tube and heated to over 500° C. for better than 45 minutes, with the resulting gases collected in a gas bulb. These gases were then injected into the gas chromatograph and the resulting retention times compared to those of known gases. The presence of ammonia was clearly indicated by this test.

EXAMPLE 2

In this example, two basic experiments were carried out employing the procedures of Example 1, the first producing what will be called the "light complex". The second producing a "dark complex".

In each case, a reaction flask is filled with 2,000 ml. of commercial 26° Be ammonia (38% by weight). Approximately 20 pieces broken from a graphite stick ½" in diameter are placed in the bottom of the flask. Two graphite rods, ⅝" in diameter are used as electrodes. One of them, approximately 20" long was brought into contact with the graphite particles at the bottom. This became the anode of the electrolytic system. The pressure was maintained at a slightly elevated level in order to minimize ammonia loss and maximize the formation of NH and $NH_2$ groups in the reaction.

(a) In the first experiment, approximately 2 amps at 12 volts was passed between the electrodes. The reaction started at room temperature and no external heat was added. No visible reaction took place, but on the second day it began to be apparent that the reaction vessel was heating. The temperature went up to approximately 50° C. and stayed there for the duration of the reaction. This reaction continued for a period of 14 days. During this time, it was apparent that the graphite anode was deteriorating, with particles of graphite de-laminating and settling at the bottom of the reaction vessel.

At the end of 14 days there was no detectable odor of ammonia and most of the graphite particles had apparently dissolved. The solution was essentially water-white and transparent, with a slight greenish-yellow tint. It had specific weight of approximately 1.05 and was fairly viscous. When poured on a glass plate and dried, it formed a film which also was clear and which was water soluble. There was no detectable odor of ammonia.

Figure 2:
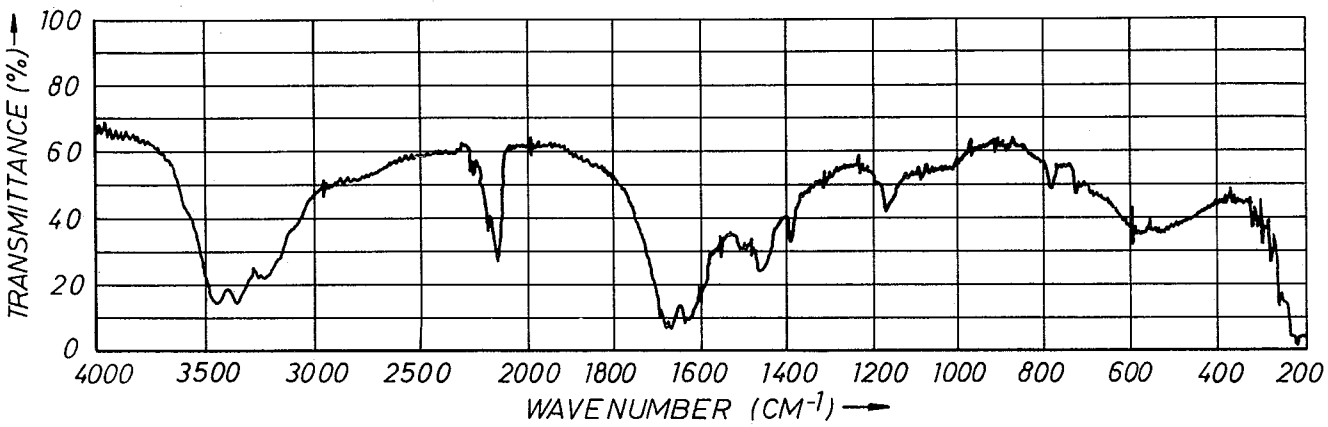
FIG. 2 is a reproduction of an infrared spectrum of a complex produced according to the present invention employing graphite as both cathode and anode with an electrolyte containing dissolved $NH_3$.

The product of this first experiment was tested and found to contain 52% by weight nitrogen, the remainder was essentially carbon and hydrogen. An infrared analysis was made of the product after it had been vacuum dried at 50° C. The IR spectrum produced is shown in the attached drawings as FIG. 2. This analysis confirmed the presence of hydrogen-nitrogen and carbon-nitrogen bonds. The graphite structure was confirmed by IR analysis through the determination that the para-carbon linkage was present in the product.

Upon heating the dry product, the odor of ammonia began to become apparent as the temperature approached about 150° C., and the color of the dry product began slowly to change. From essentially water-white, it became straw-yellow at about 200°, amber-brown at 300°, grey at 400° C. Above approximately 300° C. the product was no longer soluble in water. When heating was continued, there appeared another transformation. At about 700° C., the grey product began to turn lighter, and with further heat, at 900° C. became a transparent, very hard material.

(b) In the second reaction experiment, all parameters were kept essentially constant except for the electrolytic current. A 25 volt power source was employed this time and the current was maintained between 4 and 6 amps. In this case, there was almost immediately produced a detectable evolution of gases at both the anode and cathode. The gas evolved at the cathode is hydrogen; that evolved at the anode is ammonia. No ammonia odor was detectable after six days. The solution rather than clear, was a dark amber-brown color and there was a substantial quantity of delaminated graphite particles in the bottom of the flask. The solution was strained, dried and analysed. It was determined that this product had 32% by weight nitrogen. This comparative test illustrates the importance of avoiding the use of too large a current in the laboratory scale process of the present invention. Where graphite is employed as the anode, the carbon-carbon linkages appear to be attacked, causing production of acetylene gas and the premature breakdown of the graphite structure. If a metal anode is utilized, too much current will result in the production of oxide.

In order to further study the inorganic complexes produced according to the practice of the present invention, samples of the solutions prepared according to Example 2*a* were dried and heated in vacuum at different temperatures and the products resulting subjected to infrared analysis. The infrared scans depicted in the attached drawings, FIGS. 1A–1E, were taken as the products were heated to different temperatures. FIG. 1A shows the IR spectrum of the product vacuum-dried at 50° C. FIGS. 1B–E show the same product after it had been vacuum-dried and heated to 105° C., 300° C., 500° C. and 700° C., respectively.

With reference to FIGS. 1A–1E, it should be noted first that, after the product had been dried, no detectable ordor of ammonia was present. However, the spectrum illustrated in FIG. 1A indicates that a large amount of nitrogen and hydrogen is present in the product. This is evidenced by the peaks at or near Wave Nos. 3300, 2800, 1400 and 600–900, which indicate the presence of the NH bond. The peaks at 2200, 1650 and in the area of 800 indicate the presence of the carbon-nitrogen bonding. While the peak at 3300 may also be indicative of the presence of water in the sample, it will be noted, by reference to FIGS. 1B and 1C, for example, that the peak remains on heating under vacuum.

As the product is heated to higher temperatures, large amounts of ammonia are detected as being given off. Inspection of FIGS. 1C and 1D will confirm that the NH groups are being lost. Finally, upon heating the product to temperatures above 500°, all of the NH groups in the product are essentially broken down. This is confirmed by the fact that the product no longer gives off a detectable ammonia odor. Notice also the appearance of the carbon-nitrogen and nitrogen-nitrogen bonding as evidenced by the new peaks appearing in FIG. 1E. As will be also noted by reference to FIG. 1E, the para-carbon linkage is still present, indicating that the hexagonal graphite structure remains intact.

EXAMPLE 3

This examiple illustrates the preparation of a complex which contains both a metal and graphite. In this case the metal employed is silicon. The electrolysis used both a graphite anode and a graphite cathode.

(a) The graphite cathode and graphite anode were immersed in an electrolyte comprising 1800 grams of 26° Be aqueous ammonia ($NH_4OH$). Added to the aqueous ammonia electrolyte were 390.6 grams of high purity silicon metal. Initially the anode and cathode were arranged such that the graphite anode was in physical contact with the silicon metal located in the bottom of the electrolysis vessel. Initially a voltage of 20 volts was applied across the graphite anode and cathode and a current of 0.1 amps was drawn.

Under these conditions, operating at room temperature, a moderate reaction of the silicon metal wherein the silicon dissolved in the electrolyte was observed.

After approximately one day's time, some slight increase in the reaction rate of the silicon metal was noted. At this point, a sample of the electrolyte was taken and determined to have a pH of 12.7, at a temperature of 25° C.

After approximately 30 hours of reaction, the electrolyte became cloudy, probably indicating that too much silicon had entered the electrolyte. Shortly thereafter a bluish-white substance (probably silicon amide) began to build up on the graphite anode. It was observed after 48 hours of reaction that the graphite anode appeared covered with this build-up. At this point in the reaction, a current of 0.3 amps at a voltage of 24 volts was measured. The electrolyte was cloudy, and had a pH of 12.2. The temperature was 20° C.

At approximately this stage in the reaction, the graphite anode and cathode were removed and the white deposit scraped off both electrodes. The electrodes were then reinserted in the electrolyte at a position above the silicon metal. A voltage of 25 volts was applied between the graphite anode and cathode, drawing a current of 0.4 amps.

After approximately 72 hours of reaction, it was noted that the electrolyte darkened, apparently due to the entry of excess graphite into the electrolyte solution. At this point the voltage across the anode and cathode was 25 volts and the system drew a current of 2 amps. The build-up on the anode was again removed and the graphite anode and cathode were moved closer together, the current being adjusted to 2.25 amps at 25 volts.

Approximately 72 hours later, the current was 2 amps at 14 volts.

24 hours later the electrolysis vessel was dismantled and the electrolyte removed and filtered. Analysis of the electrolyte showed it to be an aqueous solution containing a complex which included both silicon metal and graphitic carbon moieties tied together through NH and/or $NH_2$ groups.

(b) This example was carried out similarly to the last example with silicon metal in the electrolyte medium. This example, however, was carried out to illustrate how the addition of a small amount of alkali to the electrolyte prior to current application greatly increases the conductivity of the electrolyte, thereby assisting in the dissolution of the metal.

Using the graphite anode and cathode as in part (a), above, the electrolyte was prepared from 2,275 grams of aqueous ammonia ($NH_4OH$). Some 364 grams of high purity silicon metal was placed at the bottom of the reaction flask. 72.8 grams of a 10% aqueous solution of potassium hydroxide were then fed into the electrolyte over a 20 minute period prior to current application.

The current was applied with the graphite anode being in contact with the silicon metal. The initial current was 1 amp at 6.5 volts, illustrating the very conductive nature of the electrolyte, apparently due to the presence of the potassium hydroxide in the electrolyte solution. After approximately 16 hours of reaction, the amperage was measured at 2.1 amps at 9.5 volts. Shortly thereafter the current was adjusted to 1 amp at 5.5 volts. It remained fairly constant over the next 8 hours. There was no increase in reaction temperature.

Approximately 18 hours later the system was measured to be drawing 0.9 amps at 7 volts. At this time, it was observed that the silicon was not depositing on the cathode and the current was adjusted to 1 amp at 8 volts.

Approximately 24 hours later, a heavy build-up on the anode was noted (this is probably a sodium-silicon admide). The anode was removed from the system and it was observed that there was erosion of the anode underneath the build-up. The anode and cathode were then reinserted into the electrolyte, both in position above the silicon metal. The current was adjusted to 1 amp at 6 volts.

The system was allowed to continue in this state for approximately 72 hours. After the 72 hours period, the system was again observed and the build-up of material on the anode again removed. At this time the current was adjusted at 2 amps at 12 volts.

After a further 24 hour period the current was turned off and the cathode and anode removed from the electrolyte. The electrolysis vessel containing the electrolyte was then put on a hot-plate, and heated to approximately 120° C.

After heating for approximately 1 hour the electrolysis chamber containing the electrolyte was taken off the hot-plate and it was observed that some graphite precipitated out of the solution. Several hours later the electrolyte was removed and observed. Analysis indicates that the electrolyte contains silicon metal, graphitic carbon moities and NH and/or $NH_2$ groups in the complex dissolved in the aqueous medium.

EXAMPLE 4

(a) This example was carried out using molybdenum metal in an electrolysis sytem comprising both a graphite anode and a graphite cathode immersed in an electrolyte of aqueous ammonia. To 2,100 grams of the electrolyte, 3,293.2 grams of low purity molybdenum metal were added. At the start up of the electrolysis reaction, the cathode and anode were so arranged that the graphite anode was in physical contact with the molybdenum metal within the electrolyte. Initially the system drew 0.005 amps at 20 volts. Shortly after the initiation of the reaction, the pH of the electrolyte was measured by meter and found to be 12.6 at room temperature.

Approximately 20 hours after initiation of the reaction, the system was observed to have developed a cloudy, light brown color, and the electrolyte was warm. At this time, the pH was measured 11.5 at 35° C., and the system drew 1.5 amps at 17 volts. The current was adjusted to 1 amp at 12 volts. After another four hours, the electrical leads were disconnected from the power supply and connected to an ammeter. A deflection of 0.2 amps suggested that the electrolyte solution retained dissolved electrons. The leads were again connected and the current adjusted to 1 amp at 10 volts.

Three hours later, the current had increased to 2 amps at 14 volts, and approximately 18 hours after that, the system was drawing 3.5 amps at 14.5 volts. The electrolyte was also observed to be warm and the pH measured to be 10.7 at 37° C. The solution appeared cloudy due to the presence of oxides. At this time the current was adjusted to 2 amps at 10 volts.

Approximately 6 hours later, it was noted that the reaction was getting lighter and clearer, suggesting the possibility that any metal oxides present were being reduced. The reaction was allowed to remain in this condition for an additional 16 hour period, after which it was definitely observed that the electrolyte was becoming clearer. Also metallic oxides which had collected on the sides of the electrolysis vessel were disappearing. Shortly thereafter the pH of the electrolyte was measured at 10.3 at 25° C. The current was adjusted to 2 amps at 12 volts. Approximately 3 hours later the system was again observed and it was noted that a heavy brown layer (probably a mixture of molybdenum nitride molybdenum metal and carbide) had appeared on the cathode.

Some 20 hours later the system was observed to be drawing 1.5 amps at 11.5 volts. When the electrolyte was sampled a pH of 9.6 was measured at 36° C. At this time the current was adjusted to 2 amps at 9 volts and the cathode and anode moved closer together. The reaction was allowed to remain undisturbed in this state for approximately 5 additional hours after which the electrodes were removed and the electrolyte solution containing the complex removed from the electrolysis vessel and filtered.

An analysis of the electrolyte solution showed it to be an aqueous solution of a complex containing graphitic carbon moities, molybdenum metal and NH and/or $NH_2$ linkages. When this aqueous solution was dried and the dried complex analyzed, the molybdenum content of the complex was found to be 68.12% by weight. When this aqueous solution was subjected to electrolysis using a molybdenum or graphite anode and a copper cathode, molybdenum was deposited on the copper.

(b) The procedure of part (a) was repeated using molybdenum metal, but further including some 56 grams of a 10% potassium hydroxide solution added to the electrolyte solution, over a period of about 15 minutes prior to current application. In the initial setup, both the graphite cathode and graphite electrode were again arranged so as to be above the molybdenum metal, out of physical contact therewith. Initially a current of 2 amps at 13 volts was applied.

After only 2 hours of reaction, a very fast reaction of the molybdenum metal around the graphite anode was observed. This is in contrast to the slower initiation that was achieved in the absence of the alkali, potassium hydroxide.

After approximately 18 hours of reaction, a heavy deposit of molybdenum had developed on the cathode. A new cathode was introduced into the reaction system. During the time that the current was not applied while the cathode was being replaced, the metal reaction slowed drasically, picking up again when the current was reapplied. The current was reapplied at 2 amps and 9 volts.

24 hours later the system was observed to be drawing 2 amps at 9.5 volts, with the reaction proceeding at a fast rate. Approximately 43 hours after the initiation of the reaction another new cathode had to be inserted into the electrolyte and the current adjusted to 4 amps.

Approximately 24 hours later, approximately one liter of ammonium hydroxide solution was added to the electrolyte. No release of ammonia gas from the system was observed, even though the electrolyte was warm. At this point in the reaction the system drew 2 amps at 9 volts.

The system was allowed to remain undisturbed again for approximately 4 days, after which it was observed that the system drew 2.5 amps at 8.5 volts and the reaction system was warm. Approximately 6 hours later an additional 28 grams of 10% potassium hydroxide and a new cathode were inserted in the electrolysis system. At this point the system drew 2 amps at 7 volts. The cathode that was removed from the electrolysis system was analyzed and found to contain ammonia absorbed in the graphite cathode.

Approximately 18 hours later the system was still drawing 2 amps at 7 volts and 24 hours after that an additional 28 grams of 10% potassium hydroxide were added. Six hours later the system was analyzed and found to have a pH of 9.0. An additional 28 grams of potassium hydroxide were added at this time.

It was thereafter found that the anode had eroded away over the next 12–18 hour period. Analysis of the electrolyte showed a pH of 9.0. After the addition of 56 grams of potassium hydroxide the current was set at 2 amps and 7.5 volts. After operation under these conditions for approximately 1½ hours the electrodes were removed and the electrolyte removed and filtered. The electrolysis vessel contained a considerable amount of carbon and molybdenum. The pH of the electrolyte was found to be 10.5.

When the electrolyte was analyzed, it was found to be an aqueous solution of a complex containing molybdenum, graphitic carbon and bridges comprising NH and/or $NH_2$ groups.

EXAMPLE 5:

In this example, copper metal was utilized, together with a graphite anode and a graphite cathode. The electrolysis vessel was set up with the graphite anode comprising a hollow graphite cylinder with a graphite rod extending out of a portion thereof. The cylinder was immersed in an electrolyte comprising 2800 grams of ammonium hydroxide ($NH_4OH$) solution with some 128 grams of copper metal placed inside the hollow graphite cylinder. Thus, the graphite anode was in physical contact with the copper metal. The graphite cathode was positioned inside the cylinder above the copper particles.

Current was applied from a 25 volt power source and the position of the graphite cathode inside the graphite cylinder adjusted until a suitable transfer of bubbles from the cathode to the anode was observed. At his point, the current was measured at 0.2 amps. The temperature was 19° C. and the solution immediately began to take on a pale blue hue. Some 5½ hours later, the solution color had not changed noticeably but the current had increased to 0.4 amps. at 25 volts.

The system was left undisturbed under these conditions over night. The next morning the current had increased to 1.0 amps. and the temperature was 29° C. There was some copper visible on the surface of the cathode.

After another 24 hours, the pH of the solution was measured at 12.6 and the current at 1.6. The temperature was 30° C. and the reaction was obviously continuing. Three days later the solution was a deep blue, additional copper had plated out on the cathode and the power supply was no longer working since the copper had built up to a point where it shorted out the power supply. A new cathode was inserted and 25 volts of power reapplied at which point the current was measured at 2 amps. The temperature of the reaction was 22° C. The reaction was permitted to continue for several more days at which point the electrolysis process was terminated by withdrawal of the electrodes. The electrolyte solution was removed, filtered and analyzed to contain a solution of a complex containing graphitic carbon, copper and NH and/or $NH_2$ bridges.

EXAMPLE 6:

In this example, an electrolysis system was set up employing a graphite anode and a graphite cathode immersed in an electrolyte comprising 2100 grams of standard commercial ammonium hydroxide solution. 644 grams of powdered tungsten were placed in the bottom of the electrolysis vessel and the graphite anode and cathode positioned above the mass of the metal, but out of physical contact therewith. A full 25 volts was applied across the electrodes and the reaction immediately began to be visible. A slight ammonia odor was detected.

After continuing the reaction in this manner for 48 hours, a crystalline formation began to be visible on the inside of the reactor flask. After 2 more days, tungsten metal was visible as plating out on the cathode surface.

The cathode was removed and a new cathode inserted. The power was reapplied, drawing 4 amps for approximately 6 hours and thereafter reduced to 2 amps and held constant there. After 5 more days, again the cathode was covered with a thick plating of tungsten metal and had to be replaced. The reaction was continued with a new cathode. This time, the current was set at 2 amps and 6 volts and the reaction continued for 5 more days before being terminated by removal of the electrodes.

The solution was analyzed to contain a complex containing graphitic carbon, tungsten and NH and/or $NH_2$ groups. Each of the electrodes was degassed and tested by gas chromatograph to contain ammonia.

EXAMPLES 7-15:

Using the procedures outlined in Examples 3-6, above, specifically employing a graphite cathode, a graphite anode and an electrolyte containing ammonium hydroxide, complexes were prepared with the following metals being placed in the bottom of the reaction flask:

Aluminum—Al
Titanium—Ti
Tantalum—Ta
Nickel—Ni
Beryllium—Be
Manganese—Mn
Niobium—Nb
Chromium—Cr
Zinc—Zn In each instance, a complex was prepared and analyzed to contain both graphitic carbon and the particular metal employed.

EXAMPLE 16:

In this example, the preparation of a complex according to the present invention is described utilizing aluminum as the anode with dissolved $SO_2$ gas as the electrolyte.

An electrolysis system is set up employing as anode an aluminum bar, ⅝" in diameter and approximately 2 feet long which has been coiled at one end to form a coil-spring shape approximately 10 centimeters high and 10 centimeters in diameter. A ⅝" graphite bar is utilized as the cathode. The electrodes were placed in a 1400 cc beaker, the cathode centered inside the coil of the anode and approximately one liter of deionized water added. A source of $SO_2$ gas was provided and set up so that the gas bubbled slowly through from the bottom of the beaker at a rate such that the solution was not overly agitated.

The $SO_2$ feed was initiated and the power turned on at a voltage of 20 volts. No current was drawn at first, but within a very short time a current of approximately 0.2 amps. was measured. The pH of the solution was measured at 2.0 and the temperature at 21° C.

After about 1 hour, the reaction vessel was heated by wrapping it with heating tape. The reaction became turbid and the temperature increased to approximately 50° C. within the next hour. At this point the current was measured at 1 amp and 20 volts.

The reaction was left undisturbed for a period of 5 hours, during which time the temperature remained between 55° and 60° C. and the pH in the neighborhood of 2.2. The voltage dropped and the amperage increased from 1 to a value of 2.7, at which time the voltage began to increase and the amperage to decrease. At a value of 2 amps and 20 volts, the rate of $SO_2$ was increased and the reaction continued. After another hour, the reaction was stopped and the solution analyzed. A complex product was produced containing aluminum and SH groups. The graphite cathode was removed and observed to have a strong hydrogen sulfide odor.

EXAMPLE 17:

(a) This example demonstrates the production of a complex containing graphitic carbon as the complex backbone with linkages of SH groups.

The electrolysis system employed comprised a 1400 cc beaker, filled with deionized water and containing a large, hollow graphite cylinder with a thin graphite bar inserted in the center of the cylinder. The graphite cylinder was connected as the cathode and the thin bar as the anode. $SO_2$ gas was bubbled through the beaker in the manner described in the preceeding example. The reaction was heated by wrapping the beaker with heating tape.

The $SO_2$ feed was started with the reaction medium reached a temperature of 43° C. Within 15 minutes, the power was turned on and the system measured as drawing 7 amps at 10 volts. With continued heating and increased temperature, the current was maintained essentially constant but the voltage kept dropping. After a period of some 6 hours, the reaction temperature had reached 75° C. and the voltage had dropped to 4.5. There was no visible deposition on either electrode but the electrolyte had a brownish color. There was clearly some erosion of the graphite anode and dissolution of graphite into the electrolyte.

After a reaction period of approximately 6 hours, the $SO_2$ feed was stopped and the electrodes withdrawn. The solution was filtered and vacuum-dried at 50° C. A clear film was formed which, when analyzed, was found to contain carbon, sulfur and hydrogen.

The graphite cathode used in the preparation of the carbon-sulfur complex described above was taken from the electrolysis solution and rinsed with deionized water. The electrode was then placed in a combustion tube, heated to approximately 500° C. and the gases which evolved passed through a cadmium sulfate solution. A bright yellow cadmium sulfide precipitate was produced, evidencing the presence of a sulfide.

(b) In this case, the procedure of part (a) was duplicated with the exception that there was no heating of the electrolysis reaction vessel.

The $SO_2$ feed was started with the temperature at 18° C. Within an hour the temperature had climbed to 42° C. and the system was drawing 4.0 amps. at 7.5 volts. The amperage was maintained constant throughout the reaction procedure. Again, the voltage dropped, decreasing to 4.0 volts after about 7 hours. The temperature did not go more than 1 or 2 degrees above 40° C.

Figure 3:
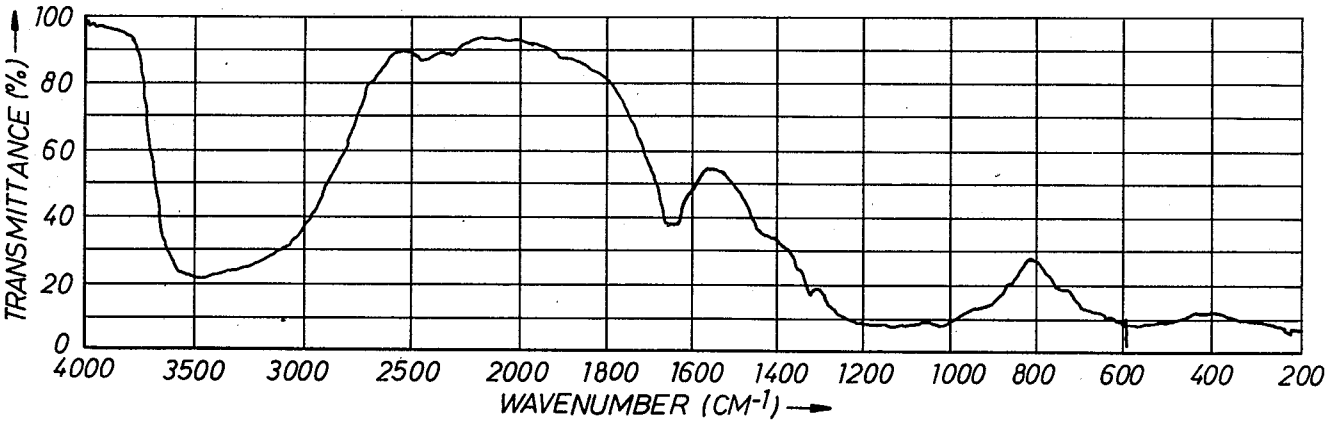
FIG. 3 is a reproduction of an infrared spectrum of a complex produced according to the present invention employing a graphite cathode, a graphite anode and $SO_2$ gas in the electrolyte.

Within a few hours, it was clear that a thin layer of sulfur was depositing on the cathode. This layer increased in thickness as the reaction continued, and may have had something to do with the fact that the reaction did not proceed as quickly as in the previous procedure. The reaction medium was a light brown color. After the electrodes were removed, the solution was filtered and analyzed to contain carbon (in graphite form) with sulfur and hydrogen bridges. An infrared spectrum of the complex produced according to this procedure after it had been vacuum-dried and heated to 105° C. is shown in the drawings as FIG. 3.

EXAMPLE 18:

In this example, the production of a graphite based complex containing P-H linkages is demonstrated.

An electrolysis system is set up comprising a graphite anode and a graphite cathode in an electrolyte consisting of 1500 grams total weight of a 10% phosphoric acid ($H_3PO_4$) solution. The electrodes are positioned according to the procedure of the invention and a current applied across the electrodes. At first, a 10 volt power supply is utilized, initially generating a current of about 4.0 amps.

The reaction is left to proceed with very little visible evidence that anything is occurring other than the bubbles generated which pass from the cathode to the anode surface. However, after several days it is observed that the reaction rate has picked up, the temperature of the electrolyte has increased and some graphite has visibly eroded from the anode surface. As the reaction proceeds, some $H_2O$ evaporation occurs, requiring the addition of water to the reaction vessel.

The reaction is stopped and the solution analyzed. An inorganic complex has been produced containing graphitic carbon and P-H linkages.

The foregoing description has been directed to particular embodiments of this invention in accordance with the requirements of the Patent Statutes and for purposes of illustration and explanation. It will be apparent, however, to those skilled in this art that many modifications and changes in the procedures set forth will be possible without departing from the scope and spirit of the invention. It is applicant's intention that the following claims be interpreted to embrace all such modifications and variations.

What is claimed is:

1. An electrolytic method for producing water-soluble inorganic complexes containing graphitic carbon which comprises passing an electric current between
   (a) a graphitic carbon cathode; and
   (b) a sacrificial graphite carbon anode, the current being passed through
   (c) an electrolyte comprising an aqueous solution of a compound capable of reduction or hydrogenation to a hydride species at the graphitic carbon cathode,
   whereby said compound is converted to a hydride species at the graphitic carbon cathode and the hydride species reacts with the sacrificial graphitic carbon anode to form the water-soluble, inorganic complex containing graphitic carbon.

2. The method of claim 1 wherein the electrolyte comprises an aqueous solution of a compound of nitrogen, sulfur or phophorus which is capable of reduction or hydrogenation to a hydride species at the graphitic carbon cathode.

3. The method of claim 2 wherein the electrolyte is aqueous ammonia.

4. The product produced by the method of claim 3.

5. The method of claim 2 wherein the electrolyte is an aqueous solution of $NO_x$ gas.

6. The product produced by the method of claim 5.

7. The method of claim 2 wherein the electrolyte is an aqueous solution of $SO_2$ or $H_2S$.

8. The product produced by the method of claim 7.

9. The method of claim 2 wherein the electrolyte is aqueous phosphoric acid.

10. The product produced by the method of claim 9.

11. The product produced by the method of claim 2.

12. An electrolytic method for producing water-soluble metal and graphitic carbon containing inorganic complexes which comprises passing an electric current between
   (a) a graphitic carbon cathode; and
   (b) a sacrificial anode comprising in combination
      (i) graphitic carbon and
      (ii) a non-alkaline metal of Groups I-VIII of the Periodic Table capable of electrolytic dissolution, the current being passed through
   (c) an electrolyte comprising an aqueous solution of a compound capable of reduction or hydrogenation to a hydride species at the graphitic carbon cathode,
   whereby said compound is converted to a hydride species at the graphitic carbon cathode and the hydride species reacts with the sacrificial anode to produce the water-soluble, metal and graphitic carbon containing inorganic complex.

13. The method of claim 12 wherein the electrolyte comprises an aqueous solution of a compound of nitrogen, sulfur or phosphorus which is capable of reduction or hydrogenation to a hydride species at the graphite carbon cathode.

14. The method of claim 13 wherein the electrolyte is aqueous ammonia.

15. The product produced by the method of claim 14.

16. The method of claim 13 wherein the electrolyte is an aqueous solution of $NO_x$ gas.

17. The product produced by the method of claim 16.

18. The method of claim 13 wherein the electrolyte is an aqueous solution of $SO_2$ or $H_2S$.

19. The product produced by the method of claim 18.

20. The method of claim 13 wherein the electrolyte is aqueous phosphoric acid.

21. The product produced by the method of claim 20.

22. The product produced by the method of claim 13.

23. The electrolytic method of claim 12 wherein the sacrificial anode comprises a physical mixture of the graphitic carbon and non-alkaline metal.

24. The electrolytic method of claim 12 wherein the non-alkaline metal of the sacrificial anode is present in the electrolyte, out of physical contact with the graphitic carbon of the sacrificial anode.

* * * * *